US005626717A

United States Patent [19]

Yin et al.

[11] Patent Number: 5,626,717

[45] Date of Patent: May 6, 1997

[54] OXIDATIVE TREATMENT OF BLEACH PLANT EFFLUENT

[75] Inventors: Caifang Yin, Monroe; Christopher P. Hung, Highland Mills; Hugh P. Gallagher; Jasper H. Field, both of Goshen, all of N.Y.

[73] Assignee: International Paper Company, Purchase, N.Y.

[21] Appl. No.: 456,729

[22] Filed: Jun. 1, 1995

[51] Int. Cl.[6] ..... D21C 11/00

[52] U.S. Cl. ..... 162/30.11; 162/30.1; 162/33; 162/DIG. 9

[58] Field of Search ..... 162/30.1, 30.11, 162/33, 161; 210/724

[56] References Cited

U.S. PATENT DOCUMENTS

| | | | |
|---|---|---|---|
| 3,961,976 | 6/1976 | Karlsson | 106/186 |
| 5,120,448 | 6/1992 | Dorica et al. | 210/724 |
| 5,149,442 | 9/1992 | Nyström et al. | 210/724 |

FOREIGN PATENT DOCUMENTS

WO94/13591 6/1994 WIPO .

OTHER PUBLICATIONS

DE 4,314,521 (abstract only) Treatment of industrial waste water contaminated with organic substances.

CA 2,096,891 (abstract only) Catalytic wet air oxidn. process for waste water treatment.

*Primary Examiner*—Donald E. Czaja

*Assistant Examiner*—Steven B. Leavitt

*Attorney, Agent, or Firm*—Luedeka, Neely & Graham, P.C.

[57] ABSTRACT

The invention described in the specification relates to a process and apparatus for the reduction of adsorbable organic halide (AOX), chemical oxygen demand (COD) and color bodies from the filtrates generated in a chlorine compound-containing pulp bleaching sequence. The method involves vigorously and intensely mixing certain pulp bleaching filtrates in order to lower the AOX content of the filtrate and the use of a peroxy compound and a ferrous salt catalyst to treat a combined filtrate streams thereby significantly reducing the level of AOX, COD and color in the effluent leaving the pulp bleaching plant.

25 Claims, 1 Drawing Sheet

OXIDATIVE TREATMENT OF BLEACH PLANT EFFLUENT

FIELD OF THE INVENTION

The present invention relates to a cost effective method for reducing adsorbable organic halides, chemical oxygen demand, toxicity and color containing compounds in the effluent from pulp bleaching plants.

BACKGROUND OF THE INVENTION

Recent environmental regulations propose more stringent containment and/or treatment regulations for bleach plant effluent containing adsorbable organic halides (AOX), biologically recalcitrant chemical oxygen demanding (COD) materials, toxicity and color containing compounds. While these more stringent regulations may be met with currently available treatment systems, the costs for achieving the proposed limits are excessive in many instances. In some situations major plant modifications may be required in order to effectively reduce the subject pollutants to the required level. In other situations, converting from elemental chlorine-free bleaching (ECF) to totally free chlorine bleaching (TCF) may be the most cost effective means to achieve the reduction in pollutants proposed in the environmental regulations. However, the conversion of bleaching plants from ECF to TCF may require major plant modifications.

Conventional pulp bleaching plants use halogen agents, which are the major source of AOX in the effluent streams. A conventional bleaching sequence for softwood pulp treated in accordance with the sulfate process is $$(C+D)E_1DE_2D$$

wherein (C+D) is a stage for the addition of chlorine (C) and chlorine dioxide (D), either simultaneously or sequentially; D is a chlorine dioxide addition stage, and $E_1$ and $E_2$ are alkaline extraction stages, optionally with addition of peroxide ($E_p$) and/or oxygen ($E_{op}$ or $E_o$). In the above bleaching sequence, the (C+D) stage and the $E_1$ stage are often referred to as the prebleaching stages. The sequence $DE_2D$ is called the final bleaching stage. In an elemental chlorine-free pulp bleaching plant, a bleaching sequence such as $D_oE_{op}D$ may be used.

The reaction products formed in the bleaching stages using halogen-containing compounds give rise to discharges containing halogenated organic compounds. These compounds are measured as absorbable organic halogen (AOX). When chlorine dioxide is used instead of elemental chlorine, the AOX may be significantly reduced. Processes using only chlorine dioxide in the prebleaching stage are typically known as elemental chlorine-free (ECF) bleaching processes. While the use of chlorine dioxide in place of elemental chlorine has reduced the level of AOX in plant effluent, there continues to be a need to further reduce the level of these compounds.

In addition to AOX, pulp bleach plant effluents typically have a high chemical oxygen demand (COD) and a high color content. Conventional primary treatment systems are designed to reduce only suspended solids (SS), not AOX, COD, and color. Other treatment systems may reduce the AOX and color of the effluent but fail to reduce the COD. Secondary or biological treatment systems are useful for reducing the biochemical oxygen demand (BOD) of the effluent but typically do not reduce color and are only moderately effective in removing AOX and COD.

Accordingly, it is an object of the present invention to provide a cost effective method for reducing pollutants in the effluent discharged from a pulp bleaching plant.

Another object of the invention is to provide a method for treating filtrate from a pulp bleaching plant whereby the effectiveness of secondary and/or tertiary treatment is increased.

Still another object of the invention is to reduce the amount of pollutants in plant filtrate streams without adversely affecting the biological treatment systems used for subsequent treatment of the filtrate streams to reduce BOD.

Yet another object of the invention is to condition filtrate streams so that subsequent biological treatment becomes more effective.

An additional object of the invention is to provide a method for treating pulp bleach plant effluent which reduces the AOX, COD and color of the effluent.

A further object of the invention is to provide a method for treating pulp bleach plant effluent which enables reduction of pollutants in the plant discharge stream to acceptably low levels in accordance with applicable standards.

A still further object of the invention is to provide a method for treating pulp bleach plant effluent which avoids radical or expensive modifications in existing plant equipment or processes.

SUMMARY OF THE INVENTION

With regard to the above and other objects, the present invention provides a method for treating effluent from a kraft pulp bleaching sequence having a chlorine and/or chlorine dioxide stage generating an organic chloride compound-containing filtrate ($F_D$) and an alkaline extraction stage generating an extraction stage filtrate ($F_E$) wherein the $F_D$ and $F_E$ filtrates contribute to the amount of the chemical oxygen demand (COD), adsorbable organic halides (AOX), color bodies, and toxicity in the bleach plant effluent. The method comprises contacting the $F_D$ filtrate with the $F_E$ filtrate at a pH above about 10 to provide an $F_DF_E$ mixture, which is then intensely mixed for a mixing interval sufficient to reduce the amount of organic chlorides primarily in the $F_D$. After the mixing interval, the pH of the $F_DF_E$ mixture is lowered to from about 3.0 to about 5.0 and the $F_DF_E$ mixture is contacted with from about 0.2 to about 2.0 grams per liter of an inorganic peroxide compound in the presence of a catalytic amount of a metal catalyst. The $F_DF_E$ mixture is preferably then held in contact with the peroxide and catalyst in a large conduit or hold tank for a reaction time sufficient to substantially reduce the amount of AOX, COD, color bodies, and/or toxicity in an effluent stream exiting the hold tank relative to the amount of AOX, COD, color bodies and/or toxicity level initially present in the $F_D$ and $F_E$ filtrates.

A particular advantage of the present treatment system is that no special equipment, major modifications or large quantities of expensive chemicals are required to achieve a significant reduction in the AOX and COD of filtrates from the chlorine dioxide and alkaline extraction stages of a pulp bleaching sequence. Furthermore, contrary to conventional techniques acidic and alkaline filtrate streams which are often kept separate because of the typically low level of suspended solids in the acidic streams may now be combined in a manner which achieves a significant reduction in the beforementioned pollutants.

SUMMARY OF THE DRAWINGS

The above and other aspects of the invention will now be further described in the following detailed description of various preferred embodiments in conjunction with FIG. 1 which is a block flow diagram of a preferred treatment system according to the invention.

DETAILED DESCRIPTION OF THE INVENTION

Figure 1:
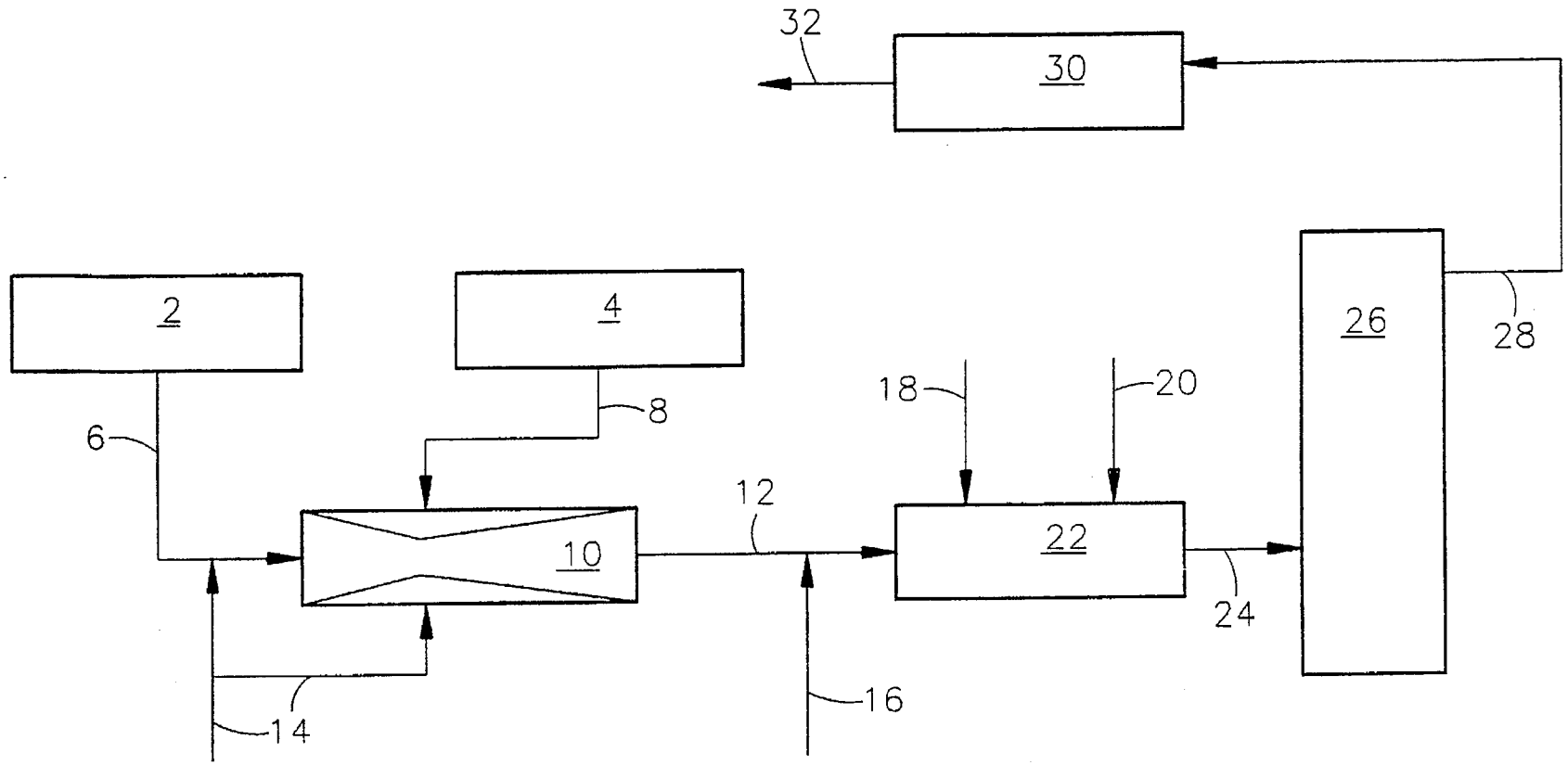

The present invention is directed to a process for reducing the amount of organic halide (AOX), chemical oxygen demand (COD) and color bodies in the effluent from a kraft pulp bleaching sequence having a chlorine and/or chlorine dioxide stage generating an organic chloride compound-containing filtrate ($F_D$) and an alkaline extraction stage generating an extraction stage filtrate ($F_E$). As is known to those of ordinary skill, among the known kraft pulp bleaching sequences there exist variations of the $(C+D)E_1DE_2D$ bleaching sequence such as those disclosed in U.S. Pat. Nos. 4,959,124 and 5,389,201 to Ted Y. Tsai, incorporated herein by reference as if fully set forth.

The $F_D$ and $F_E$ filtrates are the liquid portions separated from the pulp in the bleaching and extraction stages respectively. Liquid may be separated from the pulp by vacuum or pressure filtration, centrifugation, decantation, screening or any other well known means. Typically, the liquid separated from the pulp will contain, among other things, components contributing to the AOX, COD and color body content of the filtrate streams. While the $F_D$ and $F_E$ filtrates contribute the largest portion of the total AOX, COD and color body content in the effluent streams exiting a kraft pulp bleaching plant, other less defined sources of AOX, COD and color bodies may be combined with the $F_D$ and $F_E$ filtrates and then treated by the process of the present invention.

In a preferred embodiment, the $F_D$ filtrate, preferably the first chlorine dioxide bleaching stage, is vigorously and intensely mixed with $F_E$ filtrate, preferably the first alkaline extraction stage of the bleaching sequence at a pH above about 10.0 to provide an $F_DF_E$ mixture. The $F_DF_E$ mixture is then contacted with a peroxy compound, preferably peroxide, in the presence of a catalytic amount of an iron-containing catalyst at a pH in the range of from about 3.0 to about 5.0. After contacting, the $F_DF_E$ mixture is preferably held in the presence of the peroxide and catalyst for a period of time ranging from about 1 minute to about 60 minutes to assure essentially complete reaction between the peroxide and the mixture whereby the AOX, COD and color bodies initially present in the $F_D$ and $F_E$ filtrates are substantially reduced.

A key feature of the invention is the very intense and vigorous mixing of two filtrate streams which are frequently kept separate. The $F_D$ filtrate stream typically has a low pH and a relatively low suspended solids content. On the other hand, the $F_E$ filtrate stream typically contains a high level of suspended solids and has a relatively high pH.

Because of its low suspended solids content and the relatively high volume of the $F_D$ filtrate, treatment of this stream in a primary treatment system for removal of suspended solids is not very cost effective as compared to primary treatment of the $F_E$ filtrate. As a consequence, $F_D$ filtrate stream and the $F_E$ filtrate stream are often kept separate in order to reduce the size of the suspended solids removal system.

Contrary to conventional wisdom, the present invention combines the $F_D$ filtrate with the $F_E$ filtrate in a volume ratio of from about 1:1 to about 3:1 in order to obtain an unexpected reduction in the amount of AOX initially present in the filtrates and to provide a stream suitable for reaction with peroxide to reduce color and/or COD components prior to biologically treating the $F_DF_E$ mixture.

The $F_D$ stream will typically contain chlorinated organic compounds as a result of the use of chlorine-containing compounds in the first bleaching stage or other chlorine-based stages. Such a filtrate stream may have a pH in the range of from about 1.5 to about 4. Chlorine-containing compounds which may be used to bleach pulp include chlorine, chlorine dioxide, chlorite of alkali metals or alkaline earth metals and hypochlorite of alkali metals or alkaline earth metals. While the other halogens, e.g., fluorine, bromine and iodine, have seen limited usage for pulp bleaching system, this invention is not necessarily limited to the treatment of filtrates from a chlorine compound-containing bleaching sequence.

Organic substances which may be chlorinated as a result of the chlorine compound bleaching of wood pulp include cellulose, hemicellulose, extractive matter and aromatic and aliphatic lignin residues. An example of such a chlorinated organic substance is chlorinated lignin residues, wherein the aromatic compounds in particular are difficult to degrade to acceptably low levels.

The bulk of the chlorinated organic compounds which are found in the $F_D$ filtrate are usually formed in the first bleaching stages of the pulp bleaching process. Accordingly, an $F_D$ filtrate from an initial bleach stage may contain from about 70 to about 90 wt. % of the total AOX generated during the entire bleaching sequence. Since the filtrate from the first bleaching stage contains the highest level of AOX, a significant reduction in the AOX content of this stream translates into a substantial reduction in AOX of the effluent stream from the pulp bleaching plant.

The $F_E$ filtrate from the first alkaline extraction stage may result from treatment of the pulp with peroxide and/or oxygen along with an alkaline agent stage, typically sodium hydroxide, and will often have a pH within the range of from about 10 to about 12. The $F_E$ filtrate will typically contain much of the organic solids removed during bleaching as well as most of the color bodies which are principally made up of soluble lignin compounds removed from the pulp. Recycle or reuse of at least a portion of the $F_E$ filtrate may reduce the level of organic solids and color bodies leaving the bleach plant. However, much of the filtrate will still require treatment and disposal.

In the practice of the present invention, the $F_D$ and $F_E$ filtrates are combined and the pH adjusted so that the pH of the resulting $F_DF_E$ mixture is above about 10.0. The pH of the mixed filtrate stream may be above about 10.0 as a result of mixing the $F_D$ and $F_E$ streams in a ratio that achieves the desired pH or, preferably, the pH of the mixed filtrate stream is adjusted to a pH above about 10.0 essentially simultaneously with mixing the $F_D$ and $F_E$ filtrates by adding a basic compound, such as sodium hydroxide, potassium hydroxide, ammonium hydroxide, and the like to the mixture. In a less preferred embodiment, adjustment of the pH of the $F_DF_E$ mixture may be conducted subsequent to mixing the $F_D$ and $F_E$ filtrates.

It has also been found that mixing the $F_D$ and $F_E$ filtrates in a volume ratio in the range of from about 1:1 to about 3:1 will, in most instances, provide a substantial decrease in AOX relative to the amount of AOX initially present in the $F_D$ filtrate even without pH adjustment of the filtrate mixture.

Vigorous mixing the $F_D$ and $F_E$ filtrates is an important aspect of the invention. Mixing methods and apparatus are well known. However, it has been found that the use of an in-line static mixer or a venturi mixer provides a highly effective and low cost means for obtaining a thoroughly mixed filtrate stream. Static or venturi mixers may achieve adequate mixing of the filtrates in only about 15 seconds to about 1 minute. Other mixing techniques may require from about 15 seconds to about 5 minutes. However, shorter mixing times are more desirable in order to reduce the scale of equipment required to achieve a thoroughly mixed filtrate stream.

Once mixed, the filtrate mixture is held for a period of time sufficient to assure a substantial reaction between any reactive components in the $F_D$ and $F_E$ filtrates. The hold period may be achieved in the mixer itself or in a separate vessel adjacent to the mixer. The means used to achieve a hold period is not important, provided there is a sufficient hold period prior to the peroxide reaction step.

It is preferred to admix the $F_D$ and $F_E$ filtrates by directing the $F_E$ filtrate stream directly into the $F_D$ filtrate stream as by a venturi mixer or other suitable conduit arrangements to form a "Y" and to begin mixing at the confluence of the two streams. However, the $F_D$ and $F_E$ filtrates may be conducted to a surge vessel, mixing tank or other suitable equipment arrangement functioning as a manifold to merge the streams for mixing. It is to be noted that filtrate from other bleaching and extraction stages may be combined with the $F_D$ and $F_E$ filtrates according to the process of the present invention. However, since the $F_D$ and $F_E$ filtrates contain the great majority of compounds to be treated, a significant reduction of AOX, COD, color and/or toxicity may be achieved when the $F_D$ and $F_E$ filtrates alone are combined and treated.

After the $F_D$ and $F_E$ filtrates have been combined and thoroughly mixed, and after a suitable hold period, the $F_DF_E$ mixture is then contacted and reacted with peroxide or peroxy compound, preferably an inorganic peroxide such as hydrogen peroxide in the presence of a catalytic amount of metal catalyst. Other peroxy compounds which may be used include sodium peroxide, and organic peroxides, such as peracetic acid.

The amount of the peroxy compound is preferably within the range of from about 0.2 to about 2.0 grams per liter, most preferably from about 0.2 to about 1.0 grams per liter for a metal catalyst concentration of from about 25 to about 300 milligrams per liter.

In order to assure complete reaction of the peroxy compound with the mixed filtrate, it is preferred to hold the $F_DF_E$ mixture, catalyst and peroxide for a period of time under conditions suitable for essentially completing the reaction. Accordingly, a hold tank may be employed to insure sufficient reaction time. The hold tank is preferably an agitated mixing tank having a volume sufficient to retain the reactants in contact for a period of time of from about one minute to about 20 minutes. In the alternative, multiple agitated tanks in series or one or more enlarged conduit sections may be used in series or in parallel to provide the desired total reaction period. In still another alternative, a small mixing tank may be provided to obtain initial contact between the peroxide, catalyst and filtrate streams and an upflow column may be used to provide sufficient reaction time whereby the overflow exiting the top of the upflow column has reduced AOX, COD, color and/or toxicity levels.

The catalyst used with the peroxide reactant is a metal catalyst, preferably an iron-containing catalyst. Suitable catalysts may be selected from ferrous or ferric salts such as the sulfate, hydroxide, chloride, chlorite, chlorate, oxalate, acetate, CYTOCHROME C and the like salts. The amount of catalyst used is related to the pH of the combined filtrate stream in the presence or absence of chealating agents such as ethylenediominetetroacetic acid (EDTA), diethylenetriominepentoacetic acid (DTPA), nitrolotriacetate, and the like. For higher pH's more catalyst may be required. However, catalytic amounts ranging from about 25 to about 400 milligrams per liter as iron, preferably from about 50 to about 200 milligrams per liter as iron are highly preferred for a pH in the range of from about 3.0 to about 4.0. The amount of catalyst suitable for use at various pH's may be determined by reference to the following Table 1:

TABLE 1

| Ferrous Sulfate (mg/L) | pH |
|---|---|
| 100 | 3.0–4.0 |
| 200 | 3.5–4.0 |
| 300 | 4.0–4.5 |

The amount of catalyst required is also related to the amount of peroxide compound used, which, in turn, is determined by the concentration of AOX, COD, and color of the filtrate and the desired treatment efficiency. Therefore, the pH of the combined filtrate streams and the amount of catalyst required may be changed in accordance with the amount of peroxide used, the characteristics of the filtrate and the desired treatment results.

Depending on the form of the peroxy compound and catalyst, these materials may be added to the $F_DF_E$ mixture directly or it may be desirable to mix the materials with water before the addition to the $F_DF_E$ mixture. For example, where the peroxy compound is liquid $H_2O_2$, it may be directly added to the $F_DF_E$ mixture. If the peroxy compound is normally available as a powder, it is generally desirable to dissolve or disperse the powder in water before adding the peroxy compound to the mixture. The same is true for the catalyst material.

It is preferred to introduce the catalyst material followed by the peroxy compound into the $F_DF_E$ mixture at a spatially separate location so that both the peroxy compound and the catalyst will be able to disperse into the stream and areas of contact between relatively highly concentrated solutions of the two within the $F_DF_E$ mixture are avoided.

The peroxide reaction is preferably conducted at a temperature within the range of from about 40° to about 80° C. This temperature range may be obtained by heating or cooling one or both of the filtrate streams or by adjusting the ratio of the amount of one filtrate stream to the amount of the other filtrate stream, but such heating, cooling or adjustment will normally not be necessary.

The reaction may be conducted at any desirable pressure ranging from subatmospheric to superatmospheric. For ease of operation and equipment design it is most desirable to conduct the reaction under atmospheric pressure conditions.

With reference now to FIG. 1, other aspects and features of the invention will be illustrated. As shown in FIG. 1, an $F_D$ filtrate 6 from a D stage 2 of a bleach sequence at a temperature in the range of from about 30° to about 80° C. and a pH in the range of from about 1.5 to about 4.0 is combined using a mixing device 10 with an $F_E$ filtrate 8 from an E, $E_o$ or $E_{po}$ stage 4 having a temperature in the range of from about 30° to about 90° C. and a pH in the range of from about 8.0 to about 12.0, to produce an $F_DF_E$ mixture 12. Mixing device 10 is preferably provided by one or more venturi mixers or static in-line mixers located in one or more conduits in which the $F_DF_E$ mixture is flowing. For example, the $F_DF_E$ mixture may be split into multiple parallel substreams after merging of the $F_D$ and $F_E$ filtrates (with appropriate pH adjustment), each of the substreams being conducted through a conduit with a series of venturi or static in-line mixers located therein. The parallel conduits may then be merged together and further downstream mixing imposed on the $F_DF_E$ mixture by one or more venturi or in-line mixers, with the result being a highly mixed $F_DF_E$ mixture 12. The initial confluence of the $F_D$ and $F_E$ filtrates may be at or upstream of mixing device 10.

If the $F_DF_E$ mixture 12 does not have a pH within the desired range above about 10.0, a base 14 may be added to one or both filtrates simultaneously or prior to mixing in order to adjust the pH to the desired level.

The $F_DF_E$ mixture 12 having a pH above about 10 is then held for a period of time ranging from about 15 seconds to about 2 minutes in the mixer 10, in a section of enlarged pipe or in separate vessel (not shown). After holding the $F_DF_E$ mixture for the desired period of time, the pH of the mixture is adjusted by the addition of an acid through conduit 16 so that the pH of the $F_DF_E$ mixture is in the range of from about 3.0 to about 5.0. The pH adjustment of the $F_DF_E$ mixture may occur prior to or substantially simultaneous with the addition of a catalyst 18 and peroxy compound 20 to the $F_DF_E$ mixture.

The pH adjusted $F_DF_E$ mixture having a temperature in the range of from about 30° to about 80° C. is then conducted to a mixing device 22 for addition of a catalyst 18 and a peroxy compound 20. The mixing device 22 in the illustrated embodiment is selected to provide intense mixing of the catalyst 18 and peroxy compound 20 with the $F_DF_E$ mixture 12. Mixing device 22 is preferably provided by a series of in-line static mixers in one or more conduits 24 leading to a hold vessel 26. Alternately, mixing device 22 may be a mixing vessel located in the conduits 24 leading to the hold vessel 26.

The point of addition of the catalyst 18 and peroxy compound 20 may be at or upstream of the mixing device 22 provided the peroxy compound and catalyst are not added prior to adjusting the pH of the $F_DF_E$ mixture to within a range of from about 3.0 to about 5.0.

Once intensely mixed with the catalyst 18 and peroxy compound 20, the $F_DF_E$ mixture 24 is conducted to the hold vessel 26 for maintaining the mixture and reactants under reaction conditions sufficient to substantially complete the reaction. The hold vessel 26 may be one or a plurality of vessels which provide sufficient reaction time to substantially complete the reaction. In most circumstances, the hold period will be within the range of from about 1 minute to about 15 minutes or longer. In a particularly preferred embodiment the hold vessel 26 is an upflow column or standpipe of sufficient volume to provide the desired hold period for reaction. The column, standpipe or vessel is preferably equipped with a mixing capability to develop turbulence in the flow such as rotating impellers for active mixing or baffles or packing for static mixing of the material.

A now treated $F_DF_E$ stream 28 overflowing or otherwise emerging from the hold vessel 26 may then be fed to a secondary treatment system 30 such as a conventional biological treatment system. Conventional biological treatment systems include an aeration stabilization basin (ASB) and an activated sludge treatment system. The effluent 32 from system 30 will exhibit significantly reduced levels of AOX, COD, color and or toxicity as compared to effluent streams from a secondary treatment alone.

The following example is given by way of illustration and is not meant to limit the invention.

EXAMPLE 1

Softwood pulp having a consistency of 3 to 10% was treated in an ECF bleaching sequence having the stages $D_oE_{op}PD$. The $F_D$ filtrate from a first chlorine dioxide stage $D_o$ (3 parts) had a pH of 2.45 an AOX content of 45 mg/L, and a temperature of 48° C. The $F_D$ filtrate was combined with the $F_E$ filtrate (1 part) from a first alkaline extraction stage $E_{op}$ having a pH of 11, an AOX content of 75 mg/L, and a temperature of 82° C. The $F_D$ and $F_E$ filtrates were vigorously mixed in a venturi mixer to provide a combined $F_DF_E$ mixture having a temperature of 55° C., a pH of 3.1, an AOX concentration of 38 mg/L, a COD concentration of 1236 mg/L and a color concentration of 1259 mg/L.

Sample 8 is provided for comparison purposes and illustrates the reduction in AOX without reacting the $F_DF_E$ mixture with a peroxy compound and catalyst. For Sample 8, the ratio of the $F_D$ to the $F_E$ filtrate was selected to provide a pH in the range of from about 3 to about 3.5. In Sample Nos. 1–7, a ferrous sulfate catalyst (200 mg/L) and peroxide were added to the $F_DF_E$ mixture of sample 8 as set forth in Table 1 above. Upon reaction with peroxide, and ferrous sulfate for a hold period of ten minutes, there was a significant reduction in the AOX, COD, and color from their initial values as given the following Table 2. The AOX was determined using Method No. 53205 as described in Standard Methods 17th Edition, 1992. Color and COD were analyzed with a HACH DR/2000 instrument and procedures therefore.

TABLE 2

| Sample No. | pH | Ferrous Sulfate (mg/L) | $H_2O_2$ (g/L) | Retention Time (min.) | AOX (Reduction %) | COD (Reduction %) | Color (Reduction %) |
|---|---|---|---|---|---|---|---|
| 1 | 4.0 | 200 | 0.15 | 10 | 55 | 31 | — |
| 2 | 4.0 | 200 | 0.25 | 10 | 68 | 50 | 36 |
| 3 | 4.0 | 200 | 0.50 | 10 | 80 | 58 | 49 |
| 4 | 4.0 | 200 | 0.75 | 10 | 86 | 65 | 51 |
| 5 | 4.0 | 200 | 1.0 | 10 | 85 | 73 | 58 |
| 6 | 4.0 | 200 | 1.5 | 10 | 87 | 80 | 68 |
| 7 | 4.0 | 200 | 2.0 | 10 | 89 | 84 | 70 |
| 8 | 3–3.5 | — | — | 10 | 30 | — | — |

As illustrated by comparative Sample No. 8 there is significantly more reduction of AOX and/or COD when mixing of the $F_D$ and $F_E$ filtrates is followed by reaction of the $F_DF_E$ mixture with a peroxy compound in the presence of an iron catalyst as compared to mixing alone.

The foregoing process may be readily adapted to existing plants without undue cost or plant modification and, as illustrated, requires only minor amounts of readily available chemicals relative to the volume of combined filtrate being treated.

EXAMPLE 2

In order to further demonstrate the advantages of the invention, comparisons of various treatment schemes were made and the effect of biotreatment on the treated streams was simulated. All of the runs were based on an ECF bleaching sequence ($D_oE_{op}PD$) of softwood pulp with countercurrent filtrate recycling so that the only filtrate discharges from ECF bleaching are from the first chlorine dioxide ($D_o$) and alkaline extraction ($E_{op}$) stages. Since the AOX, COD and color contents from later bleaching stages (e.g., DED) were negligible, these amounts were not used to calculate the overall reductions in AOX, COD and color. The bleaching consistencies of the $D_o$ and $E_{op}$ stages were 3 wt. % and 10 wt. % respectively and the washing dilution factor for the washer stage was 1.5. The $F_D$ and $F_E$ filtrate volume ratio used was 3:1, the filtrates were mixed in polycarbonate flasks and the pH's were adjusted with $H_2SO_4$ and NaOH. The flasks were transferred to a cold storage room (4° C.) after filtrate mixing prior to AOX determination.

In Run No. 1, the $F_D$ and $F_E$ filtrates having an initial AOX concentration of 38 mg/L and COD of 1118 mg/L were combined and mixed and at a temperature of 55°–60° C. and the pH was simultaneously adjusted to pH 10–11. In Run No. 2, the streams had an initial AOX level of 38 mg/L, a COD level of 1096 mg/L and an initial color of 1195 mg/L were mixed as in Run #1 with the exception that there was no pH adjustment. Hence the pH of the combined streams was 3.0–3.5. After mixing, the stream was treated with peroxide at 0.5 g/L in the presence of a ferrous sulfate catalyst. Run No. 3 was conducted as in Run No. 1, however the pH was adjusted to 10–11 prior to peroxide treatment and subsequently lowered to a pH of 4.0 for the peroxide treatment step. The results of the estimated biotreatment of the treated streams are given in Table 3.

TABLE 3

| | AOX | | COD | | Color | |
|---|---|---|---|---|---|---|
| | mg/L | Red. % | mg/L | Reduction % | mg/L | Reduction % |
| Run No. 1 | | | | | | |
| $F_DF_E$ pH 10–11 | 13 | 66 | 1118 | — | 1195 | — |
| Biotreatment | 11 | 15 | 648 | 42 | — | — |
| Overall | −27 | 71 | −470 | 42 | — | — |
| Run No. 2 | | | | | | |
| $F_DF_E$ pH 3.0–4.0 | 29 | 24 | 1096 | — | 1195 | — |
| $H_2O_2$ (0.5 g/L) at pH as is | 8 | 72 | 462 | 58 | 555 | 53 |
| Biotreatment | 7 | 15 | 434 | 6 | — | — |
| Overall | −31 | 82 | −662 | 60 | −640 | 53 |
| Run No. 3 | | | | | | |
| $D_o + E_{op}$ pH 10–11.0 | 13 | 66 | 1096 | — | 1195 | — |
| $H_2O_2$ (0.2 g/L) at pH 4.0 | 6.5 | 50 | 416 | 62 | 848 | 29 |
| Biotreatment | 5.5 | 15 | 399 | 6 | — | — |
| Overall | −32.5 | 86 | −697 | 64 | −347 | 29 |

As illustrated by the foregoing examples, combining the $F_D$ filtrate with the $F_E$ filtrate without any pH adjustment and treating the mixed stream with peroxide in the presence of ferrous sulfate catalyst is estimated to result in the most dramatic decrease in the AOX, COD and color levels of the effluent, particularly after biological treatment of the treated stream. With pH adjusted to 10–11 in the mixing pretreatment stage and subsequently adjusting the mixture pH to about 4, the overall AOX and COD removal efficiencies may be increased at a lower peroxide compound charge as shown in Run No. 3 of Table 3.

EXAMPLE 3

In the next series of runs, the effect of the pH of the peroxide treatment step relative to removal of AOX and COD is illustrated. The $F_D$ and $F_E$ filtrates treated were from $D_o$ and $E_{op}$ stages of a $D_oE_{op}PD$ bleaching sequence. The peroxide and catalyst treatment time was 10 minutes at a temperature of 60° C. Peroxide dosage was 0.75 mg/L and a ferrous sulfate catalyse was used in the amounts indicated in Table 3. The $F_D$ and $F_E$ filtrates were initially mixed and held at a pH of 3.0 for up to 60 minutes prior to peroxide treatment. The initial AOX concentration after mixing of the filtrates was 34 mg/L and the initial COD content was 1240 mg/L. Result of the further reduction in AOX and COD concentrations after peroxide treatment are given in Table 4.

TABLE 4

| Run No. | Fe Conc. (mg/L) | pH | $H_2O_2$ consumed (%) | AOX mg/L | AOX Removal % | COD mg/L | COD Removal % |
|---|---|---|---|---|---|---|---|
| 1 | 100 | 3.0 | 88 | 12 | 65 | 598 | 52 |
| 2 | 100 | 4.0 | 87 | 14 | 59 | 846 | 32 |
| 3 | 100 | 4.5 | 68 | 15 | 56 | 1008 | 19 |
| 4 | 200 | 3.0 | 91 | 10 | 71 | 582 | 53 |
| 5 | 200 | 4.0 | 87 | 10 | 71 | 485 | 61 |
| 6 | 200 | 4.5 | 85 | 12 | 65 | 758 | 39 |
| 7 | 300 | 3.0 | 83 | 12 | 65 | 502 | 60 |
| 8 | 300 | 4.0 | 86 | 9 | 73 | 420 | 66 |
| 9 | 300 | 4.5 | 85 | 8 | 76 | 428 | 65 |

As illustrated in the foregoing example, there is typically more reduction in AOX and COD at an iron concentration of about 200 mg/L and a pH of 3.5 to 4.0. However, lower or higher amounts of iron and pH levels may be used if desired as indicated by the results in the foregoing Table 3.

Having described the invention and preferred embodiments thereof, it will be recognized by those of ordinary skill that variations in the invention are within the spirit and scope of the appended claims.

What is claimed is:

1. A method for treating effluent from a kraft pulp bleaching sequence having a chlorine and/or chlorine dioxide stage generating an organic chloride compound-containing filtrate ($F_D$) and an alkaline extraction stage generating an extraction stage filtrate ($F_E$) wherein the $F_D$ and $F_E$ filtrates contribute to the amount of the chemical oxygen demand (COD), adsorbable organic halides (AOX), color bodies, and toxicity in the bleach plant effluent, the method comprising:

contacting $F_D$ filtrate with the $F_E$ filtrate at a pH above about 10 to provide an $F_DF_E$ mixture;

vigorously mixing the $F_DF_E$ mixture for a mixing interval sufficient to reduce the AOX of the $F_D$;

lowering the pH of the $F_DF_E$ mixture to from about 3.0 to about 5.0;

contacting the $F_DF_E$ mixture prior to any biological treatment thereof with from about 0.2 to about 2.0 grams per liter of peroxy compound in the presence of a catalytic amount of a metal catalyst; and holding the $F_DF_E$ mixture in contact with the peroxide compound and catalyst in a hold vessel for a reaction time sufficient to substantially reduce the amount of AOX, COD, color bodies and/or toxicity initially present in the $F_D$ and $F_E$ filtrates.

2. The method of claim 1 wherein the pulp bleaching sequence is an elemental chlorine free bleaching sequence.

3. The method of claim 1 wherein the $F_D$ filtrate is from a first chlorine dioxide ($D_o$) bleaching stage.

4. The method of claim 1 wherein the alkaline extraction stage is an $E_{op}$ stage.

5. The method of claim 1 wherein the peroxy compound is hydrogen peroxide.

6. The method of claim 1 wherein the mixing interval is from about 15 seconds to about 5 minutes.

7. The method of claim 1 wherein the catalytic amount of metal catalyst is within the range of from about 25 to about 400 milligrams per liter as iron.

8. The method of claim 1 wherein the reaction time ranges from about 1 to about 20 minutes.

9. The method of claim 1 wherein the metal catalyst is derived from ferrous sulfate.

10. The method of claim 9 wherein the amount of ferrous sulfate ranges from about 50 to about 250 milligrams per liter as iron.

11. The method of claim 1 wherein the $F_DF_E$ mixture is contacted with an inorganic peroxide at a pH within the range of from about 3.0 to about 4.5.

12. A system for reducing pollutants from an elemental chlorine-free pulp bleaching plant, comprising:

a mixer for mixing an $F_D$ filtrate from a chlorine dioxide bleaching stage with an $F_E$ filtrate from an alkaline extraction stage to form an $F_DF_E$ mixture;

a peroxide contact system for contacting the $F_DF_E$ mixture with a peroxide in the presence of a metal catalyst prior to any biological treatment system; and a biological treatment system for treatment of the contacted mixture from the peroxide contact system.

13. The system of claim 12 wherein the mixer is a venturi mixer.

14. The system of claim 12 wherein the mixer is an in-line static mixer.

15. The system of claim 12 wherein the biological treatment system is a conventional aeration stabilization basin (ASB) or an activated sludge treatment system.

16. The system of claim 12 wherein the peroxide contact system comprises a contact tank and an upflow column having a size and configuration sufficient to provide a reaction hold time of about 1 to about 60 minutes.

17. A process for reducing organic halide (AOX), chemical oxygen demand (COD) and color bodies in an effluent from a pulp bleaching sequence having a chlorine and/or chlorine dioxide stage generating an organic chloride compound-containing filtrate ($F_D$) and an alkaline extraction stage generating an extraction stage filtrate ($F_E$), the process comprising:

vigorously mixing the $F_D$ filtrate from a first chlorine dioxide bleaching stage with the $F_E$ filtrate from a first alkaline extraction stage of the bleaching sequence at a pH above about 10.0 to provide an $F_DF_E$ mixture;

contacting the $F_DF_E$ mixture prior to any biological treatment thereof with an amount of peroxide in the presence of a catalytic amount of iron-containing catalyst at a pH in the range of from about 3.0 to about 5.0; and holding the contacted $F_DF_E$ mixture in the presence of the peroxide and catalyst for a period of time ranging from about 1 minute to about 60 minutes to assure essentially complete reaction between the peroxide and the mixture whereby the AOX, COD and color bodies initially present in the $F_D$ and $F_E$ filtrates are substantially reduced.

18. The process of claim 17 wherein the volume ratio of the $F_D$ filtrate to the $F_E$ filtrate is within the range of from about 0.5:1 to about 4:1.

19. The process of claim 17 wherein the peroxide compound is hydrogen peroxide.

20. The process of claim 17 wherein the $F_D$ and $F_E$ filtrates are mixed for a period of time ranging from about 15 seconds to about 60 minutes.

21. The process of claim 17 wherein the amount of iron-containing catalyst ranges from 25 to about 400 milligrams per liter as iron.

22. The process of claim 21 wherein the iron-containing catalyst is ferrous sulfate.

23. The process of claim 22 wherein the $F_DF_E$ mixture is contacted with peroxide at a pH in the range of from about 3.0 to about 5.0.

24. The process of claim 17 wherein the $F_DF_E$ mixture has a pH in the range of from about 3.0 to about 5.0.

25. The process of claim 17 wherein the amount of peroxide ranges from about 0.2 to about 2.0 grams per liter.

* * * * *